US012465185B2

(12) United States Patent
Wiltshire

(10) Patent No.: US 12,465,185 B2
(45) Date of Patent: Nov. 11, 2025

(54) FLOOR TREATMENT MACHINE

(71) Applicant: NUMATIC INTERNATIONAL LIMITED, Surrey (GB)

(72) Inventor: Simon Wiltshire, Surrey (GB)

(73) Assignee: Numatic International Limited (GB)

( * ) Notice: Subject to any disclaimer, the term of this patent is extended or adjusted under 35 U.S.C. 154(b) by 666 days.

(21) Appl. No.: 17/050,245

(22) PCT Filed: Apr. 23, 2019

(86) PCT No.: PCT/GB2019/051123
§ 371 (c)(1),
(2) Date: Oct. 23, 2020

(87) PCT Pub. No.: WO2019/207290
PCT Pub. Date: Oct. 31, 2019

(65) Prior Publication Data

US 2021/0267427 A1 Sep. 2, 2021

(30) Foreign Application Priority Data

Apr. 25, 2018 (GB) ..... 1806768.6

(51) Int. Cl.
*A47L 11/08* (2006.01)
*A47L 11/40* (2006.01)

(52) U.S. Cl.
CPC ..... *A47L 11/08* (2013.01); *A47L 11/4072* (2013.01); *A47L 11/4075* (2013.01); *A47L 11/4091* (2013.01)

(58) Field of Classification Search
CPC ..... A47L 11/08; A47L 11/10; A47L 11/14; A47L 11/16; A47L 11/22; A47L 11/24;
(Continued)

(56) References Cited

U.S. PATENT DOCUMENTS 2,949,619 A 8/1960 Holt
3,747,430 A * 7/1973 Miner ..... A47L 11/4075 74/523

(Continued)

FOREIGN PATENT DOCUMENTS

EP 2832272 7/2014
EP 2832277 A2 * 2/2015 ..... A47L 11/26
WO WO-2007003292 A1 * 1/2007 ..... A47L 11/32

OTHER PUBLICATIONS

English Translation of EP 2832277 A2 (Year: 2015).*

*Primary Examiner* — Monica S Carter
*Assistant Examiner* — Christopher Soto
(74) *Attorney, Agent, or Firm* — Dorsey & Whitney LLP

(57) ABSTRACT

The present invention relates to the field of floor treatment machines for scrubbing, polishing, sanding or burnishing floors, and in particular machines in which one or more driven rotatable work heads (such as scrubbing brushes) are provided for agitating the floor surface. In one aspect there is provided a walk-behind floor treatment machine comprising: a base portion provided with and supported by at least one rotatable work head for treating the floor, a handle portion for steering or guiding the machine along a working direction of travel and adapted to be pivotable with respect to the base portion, drive means for rotating the work head with respect to the base portion, floor-engaging wheel means for supporting the handle portion, the wheel means having a substantially transverse axis of rotation so as to permit travel in the working direction, the wheel means being coupled to the base portion by a linkage which permits vertical travel of the base portion and associated work head or heads with respect to the wheel means, but which provides transverse constraint to limit or prevent yawing of the base portion with respect to the wheel means, wherein a lower region of the handle portion is pivotably connected to
(Continued)

the wheel means via an articulated joint, the arrangement being such that the handle portion may be manipulated to act on the wheel means so as to yaw steer the wheel means about a yaw axis defined by the floor-engaging contact of the wheel means, the yawing of the wheel means causing the base portion to yaw in response to yaw steering. The wheel means may comprise a wheel, roller or ball, preferably a single wheel, roller or ball, disposed at a lower region of the handle portion. The wheel means preferably has a fixed transverse axis of rotation.

15 Claims, 5 Drawing Sheets

(58) Field of Classification Search
CPC ..... A47L 11/26; A47L 11/28; A47L 11/282; A47L 11/283; A47L 11/4058; A47L 11/4072; A47L 11/4075; A47L 11/4091
USPC ..... 15/49.1, 50.1, 52, 79.1, 79.2
See application file for complete search history.

(56) References Cited

U.S. PATENT DOCUMENTS

| | | | | |
|---|---|---|---|---|
| 5,765,250 | A | 6/1998 | Lee | |
| 2008/0148512 | A1* | 6/2008 | Beskow | A47L 11/302 15/350 |
| 2009/0056065 | A1* | 3/2009 | Finke | A47L 5/28 15/354 |
| 2012/0246848 | A1* | 10/2012 | Hruby | A47L 11/4083 15/98 |
| 2014/0331445 | A1* | 11/2014 | Thorne | A47L 9/325 15/415.1 |
| 2015/0313436 | A1* | 11/2015 | Ruffo | A47L 11/4044 15/4 |
| 2021/0076894 | A1 | 3/2021 | Wiltshire et al. | |

* cited by examiner

FLOOR TREATMENT MACHINE

The present invention relates to the field of floor treatment machines for scrubbing, polishing, sanding or burnishing floors. In these machines one or more driven rotatable work heads (such as scrubbing brushes) are provided for agitating the floor surface. In particular the invention relates to a walk-behind machine provided with a handle for steering and guiding the machine as it travels over a floor surface.

EP2832277 (i-mop GmbH) discloses a walk-behind wet floor scrubber have two side-by-side work heads, each comprising disc-shaped floor brushes. There is a trailing squeegee and associated suction drive and reservoir for collecting liquid from the floor surface. The brushes support the weight of the machine and counter-rotate to provide propulsive force. The suction drive is disposed on a handle portion of the machine, along with a clean water reservoir for feeding a cleaning-liquid dispenser. The hand has dual pivot axes permitting up/down handle movement as well as side-to-side. A problem with these machines is that they are not very directional stable. This arises from the lack of guiding constraint provided by rotating work heads and by the dual pivoted handle which permits the user to make easy side-to-side sweeping movements along arcs, but is less suited to straight line movement of the machine methodically over a surface to be cleaned. In addition, these machines are difficult to turn sharply to go around corners or obstructions. The effort to control the machines can tire the operator and limit productivity.

The present invention seeks to provide a floor treatment machine which has better directional control, especially straight line and cornering control. These aims and others are met by the present invention in its various aspects, as will be evident from the following description.

According to one aspect of the present invention there is provided a floor treatment machine (preferably walk-behind) comprising:

- a base portion provided with and supported by at least one rotatable work head for treating the floor,
- a handle portion for steering or guiding the machine along a working direction of travel and adapted to be pivotable with respect to the base portion,
- drive means for rotating the work head with respect to the base portion,
- floor-engaging wheel means for supporting the handle portion, the wheel means having a substantially transverse axis of rotation so as to permit travel in the working direction, the wheel means being coupled to the base portion by a linkage which permits vertical travel of the base portion and work head or heads with respect to the wheel means, but which provides transverse constraint to limit or prevent yawing of the base portion with respect to the wheel means,
- wherein a lower region of the handle portion is pivotably connected to the wheel means via an articulated joint, the arrangement being such that the handle portion may be manipulated to act on the wheel means so as to yaw steer the wheel means about a yaw axis defined by the floor-engaging contact of the wheel means, the yawing of the wheel means causing the base portion to yaw in response to yaw steering.

The wheel means may comprise a wheel, roller or ball, singular or co-axial adjacent pairs. Preferably there is a single wheel, roller or ball, most conveniently disposed at a lower region of the handle portion. The wheel means may preferably have a fixed transverse axis of rotation (when placed on the floor). In other words there is no caster wheeling. The wheel or roller may however be adapted to tilt into a turn (so it tilts about an axis coaxial with the direction of travel).

The linkage which couples the wheel means and the machine base portion may comprise a pitch pivotal connection to the wheel means. This connection may be coaxial with the wheel means axis of rotation. Furthermore, or in the alternative, the linkage may comprise a pitch pivotal connection to the base portion. Preferably the linkage has both such pivots so as to permit vertical travel of the base portion with respect to the wheel means. The linkage may conveniently comprise one, or preferably two side by side struts, with a pivoted connection to the base portion at one end of the strut(s) and a pivoted connection to the wheel means at the other.

Said one or more rotatable work heads preferably supports the base portion on the floor surface with the linkage permitting floating vertical travel of the work heads with respect to the wheel means. A lower region of the handle portion may be attached to the wheel means via an articulated joint which permits up/down pivoting of the handle about the joint. The articulated joint may permit side-to-side pivoting of the handle about the joint. The up/down pivot of the articulated joint may be provided at a pivot which is co-axial with the wheel means axis of rotation. The side-to-side pivot of the articulated joint may be provided at a location vertically spaced apart from the up/down pivot. The articulated joint may comprise a yoke which accommodates a wheel, roller or ball of the wheel means, which yoke preferably pivots about the wheel rotation axis. The side-to-side pivot may be disposed on an upper bridging portion of the yoke. The side-to-side pivot may comprise a U-section bracket rotated 90 degrees with respect to the yoke and which receives a lower end of the handle, with a pivot pin bridging the bracket cheeks.

The base portion and associated work head(s) may be disposed at a front region of the machine. The wheel means may be disposed aft of the work head(s) and base portion with the linkage coupling extending between the wheel means and base portion (preferably generally centrally of machine or a centre region of the base portion).

In a preferred aspect of the invention, the machine is a wet scrubbing machine. It may be provided with a cleaning fluid reservoir and cleaning fluid delivery outlet. A squeegee liquid collector is preferably provided which is coupled to the machine by a trailing linkage. The linkage may permit up/down travel of the squeegee collector with respect to the wheels means. The trailing linkage is preferably pivotably coupled to the wheel means co-axially with the transverse axis of the wheel means. The machine may be provided with a squeegee suction drive and dirty liquid collection reservoir.

Two spaced apart, rear facing support wheels or rollers may be provided projecting to the rear of the squeegee collector. The squeegee collector may be able to adopt a transport (or storage) configuration in which the squeegee is pivoted down and depending from the trailing linkage (with the wheels/rollers on the floor), or folded up vertically away from the floor. The wheels may simply be for supporting the squeegee collector.

Forward propulsion of the machine is preferably provided by work head rotation. For transversely mounted rollers the direction of rotation controls forward or backward movement. For the preferred disc-shaped work heads which rotate about a vertical axis, the propulsion can be provided by using two work heads which counter-rotate. For a single such work head, the user can roll the handle slightly to roll the work head lightly which will cause improved traction on one side of the work head, which will induce forward propulsion if that side is the returning rotational side.

The drive means may comprise one or more electric motors carried by the base portion and coupled to the work head or heads. In a preferred arrangement there are two generally disc-shaped work heads disposed side-by-side and oriented to rotate about a respective vertical axis of rotation. There are conveniently two electric motors, each disposed above its associated work head. Other arrangements are possible, such as a single motor which drives both heads via a pulley, chain or gear train. For simplicity a single motor for each head is preferred. The twin motors are configured and/or controlled to cause the work heads to counter rotate with respect to one another, thereby to provide a propulsive force. Scrubber brush driven machines are well known in the art. For example a single brush may be induced to drive by tilting the machine (base portion) onto the retreating side of a rotating disc-shaped, floor facing, work head.

The machine of the invention is preferably a walk-behind machine. To ease handling and guiding a distal end of the handle portion may be provided with a transversely oriented handle bar for the user to grip with a hand on each side of the bar. The handlebar may be provided with a speed control lever and cleaning fluid dispensing actuator.

Following is a description by way of example only and with reference to the accompanying drawings of one mode for putting the present invention into effect.

Figure 1:
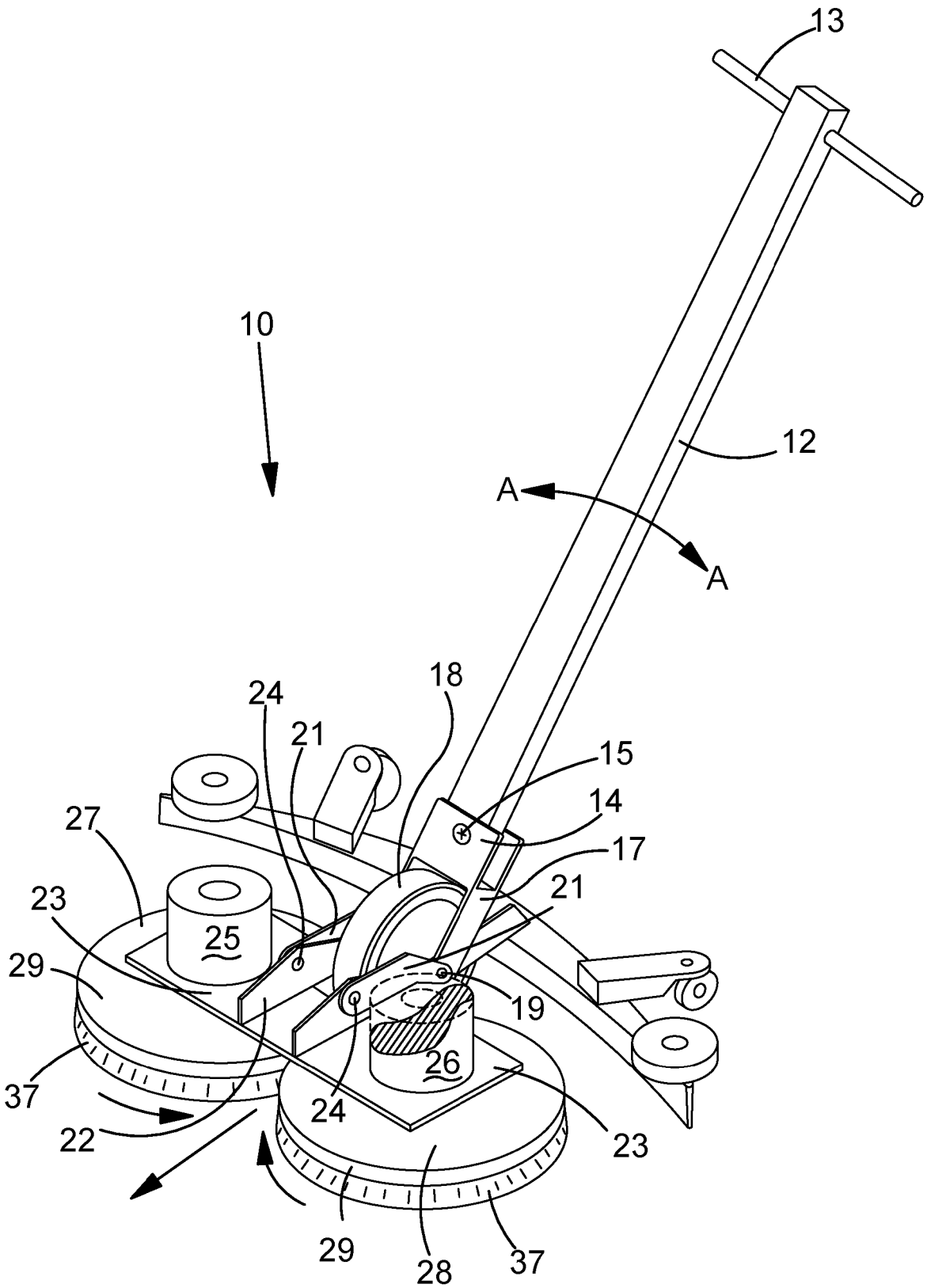
FIG. 1 is a three quarter perspective view from above of a floor scrubber dryer that is an embodiment of the present invention.
Figure 2:
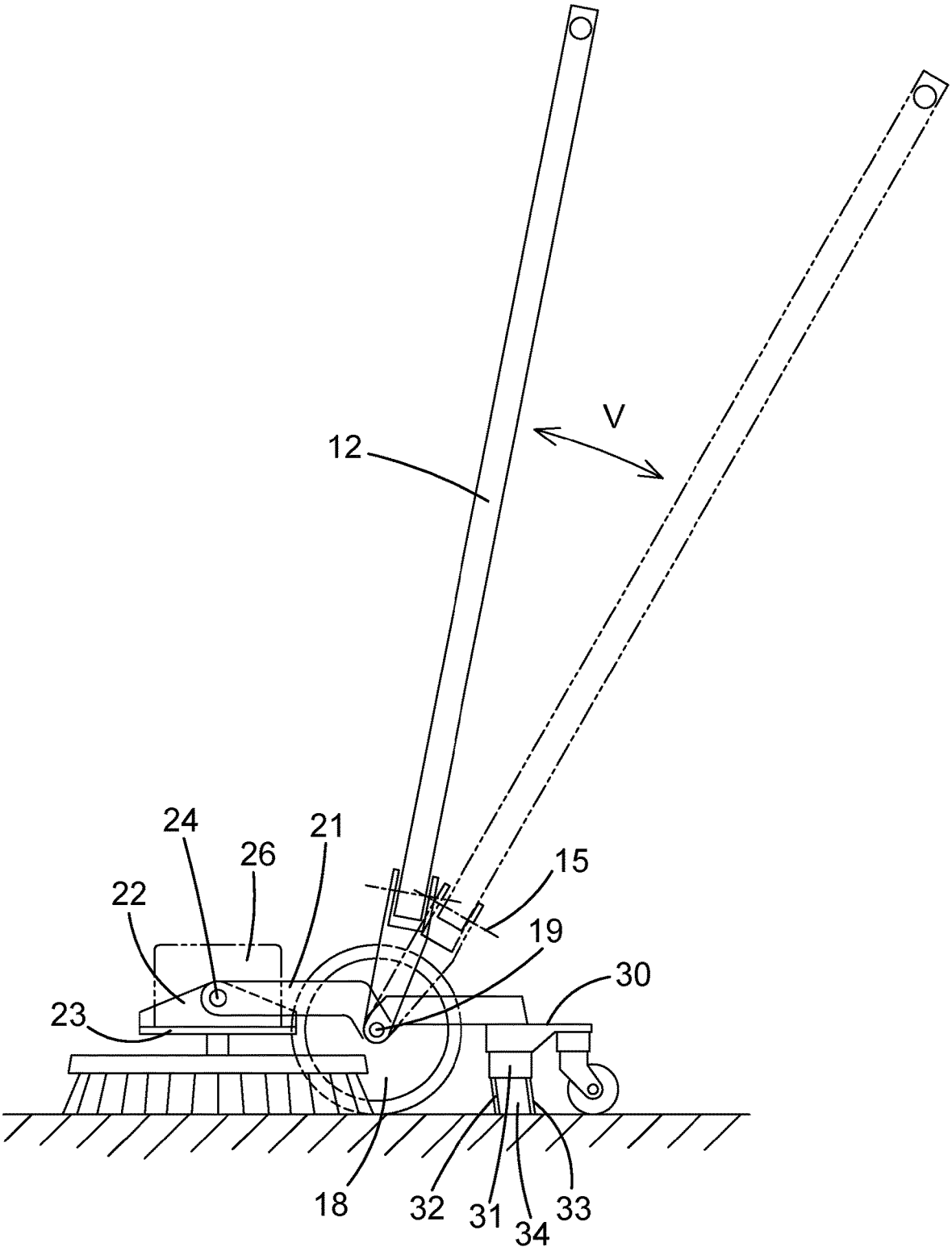
FIG. 2 is a side view of the floor scrubber dryer of FIG. 1.
Figure 3:
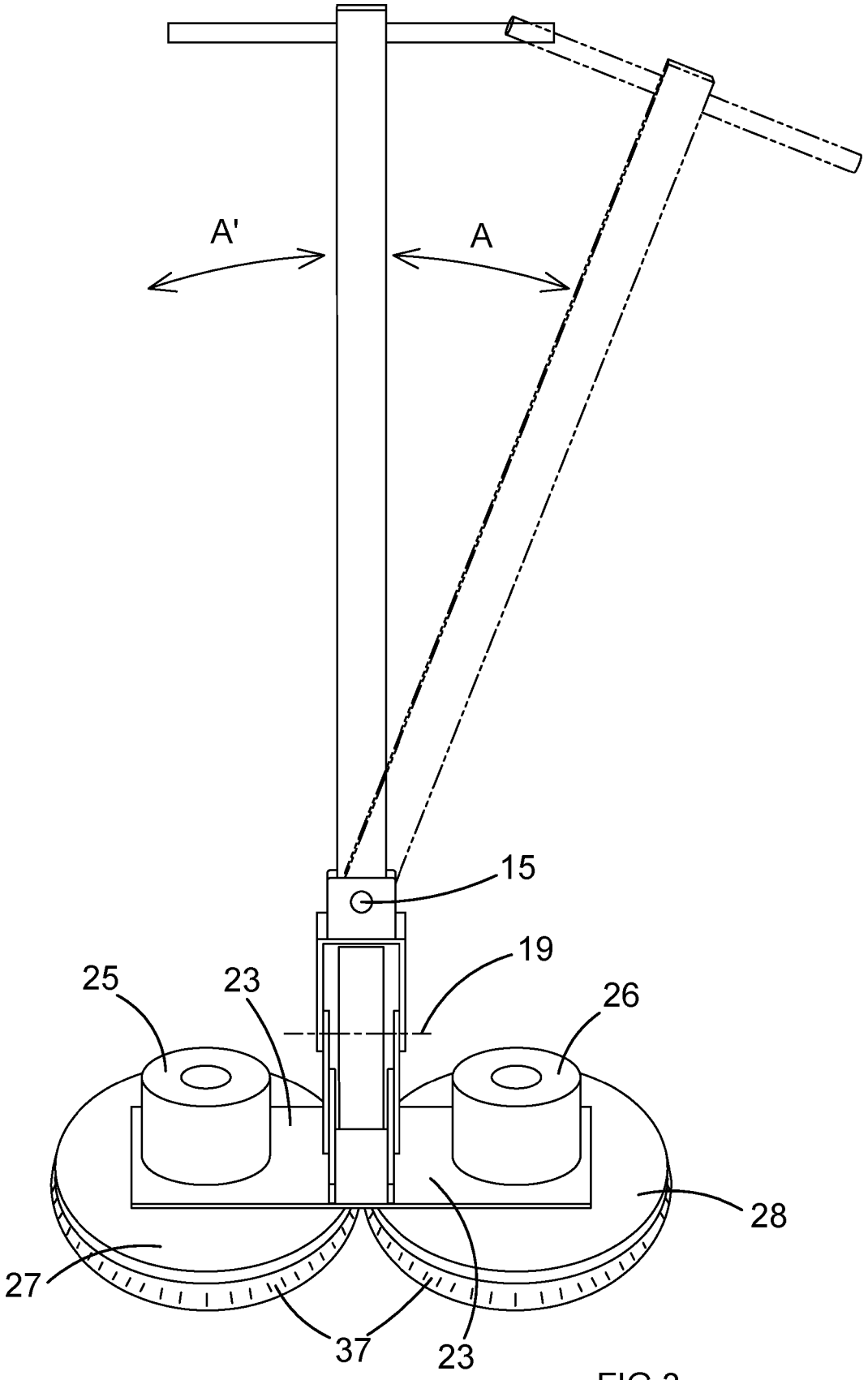
FIG. 3 is a front perspective view of the floor scrubber dryer of Figures and 2.

FIGS. 4*a*-4*d* are plan views of the floor scrubber dryer of FIGS. 1-3 in various use configurations.

In FIG. 1, a floor scrubber dryer machine in accordance with the present invention is shown generally as 10. The machine comprises an elongate rectangular section handle portion 12. The handle portion 12 comprises a top end region and a bottom end region. A handlebar 13 is transversely mounted via a bore at the top end region of the handle portion 12. A control unit (not shown) is also provided at the top end region. During use the user walks behind the machine and guides it over the floor surface to be cleaned using the handlebar 13.

The bottom end region of the handle portion 12 is pivotally attached between upstanding ear portions of a U-section mounting bracket 14. The pivot is oriented fore-aft to enable side-to-side rotation of the handle portion relative to the bracket 14 about a pivot axis 15, as shown in the arrows A, A' of FIG. 3. The axis 15 is substantially perpendicular to the length of the handle portion 2 and permits the handle to be swung transversely from side to side about the bottom end region.

The bracket 14 has a lower region which is configured as a fork or yoke 17 formed by two spaced apart downwardly extending cheek plates. A guide wheel 18 is located between the cheek plates and mounted for rotation about an axle 19, as shown in FIG. 2. The axle permits the top end region of the handle to be pivoted forward/backwards, up/down through an arc V around the transverse axis provided by the axle 19.

In the present embodiment the wheel 18 is arranged to enable rotation about a single axis and is otherwise fixed in position. However, in other embodiments, the wheel 18 may be configured to lean either left or right into a turn as a user manoeuvres the machine 18 around the floor surface. This can improve the handling of the machine 10. The same leaning could apply to other wheel means such as rollers or balls A pair of elongate, forwardly extending, spaced apart mounting struts 21 are pivotally attached at rear end regions thereof to opposite respective sides the wheel axle 19 projecting from either side of the wheel 18. Front end regions of each strut are attached to a pair of upstanding, spaced apart generally triangular brackets 22 formed on a rectangular work base plate 23. The attachment is made via a pivot connection 24 having a transverse axis of rotation.

The base portion supports thereon two electric motors side by side which are a left scrubber electric motor 25 and a right scrubber electric motor 26. A left scrubber brush 27 and a right scrubber brush 28 are attached under the base portion 23 to depending respective rotors (not shown) of the electric motors. The left scrubber and right scrubber are mounted to the rotors using conventional means such as a hub or chuck (not shown).

Each scrubber brush 27, 28 comprises a disc shaped base portion 29, and an annular array of fibre brushes 30, fixed an underside of the base portion. The scrubber brushes are arranged to enable rotation in opposite directions and about parallel vertical axes as shown in FIG. 1, which can provide forward or rearward propulsion Pivotally mounted to the rear of the wheel 18 is a squeegee collector 30, best seen in FIG. 2. The collector 30 comprises an elongate lenticular form collector arm 31. A forward collector blade 32 and a rear collector blade 33 are mounted below the collector arm 31 such that both the forward blade 32 and rear blade 33 are able to be in contact with a floor when the machine 1 is in normal use. The collector blades 32, 33 are made of an elastomeric material, as is conventional. The squeegee interior (chamber 34) defined between the forward and rear blades is in fluid communication with a suction drive (not shown) which may be mounted on the handle 12 or the base portion 23 so as to entrain and draw-up waste water that has passed through the scrubbers brushes. Waste water drawn-up from the suction chamber 34 is stored in a tank (not shown). The suction drive and tank may be positioned above the scrubber mount 11, or on the handle portion 2, or at another convenient location on the machine 1.

A left rear wheel assembly 35 and a right rear wheel assembly 36 are both mounted to the collector arm 31 and projecting rearwardly and co-terminously. Each rear wheel assembly comprises a rear castor wheel. The squeegee collector is attached to the wheel axis 19 by a pair of transversely spaced apart rearwardly extending struts 38, so that the collector can pivot up/down around the wheels axis. The squeegee collector can thus be folded up or down for storage. Furthermore the collector can, when in use, follow floor undulations without losing suction as the machine move forwards.

Figure 4B:
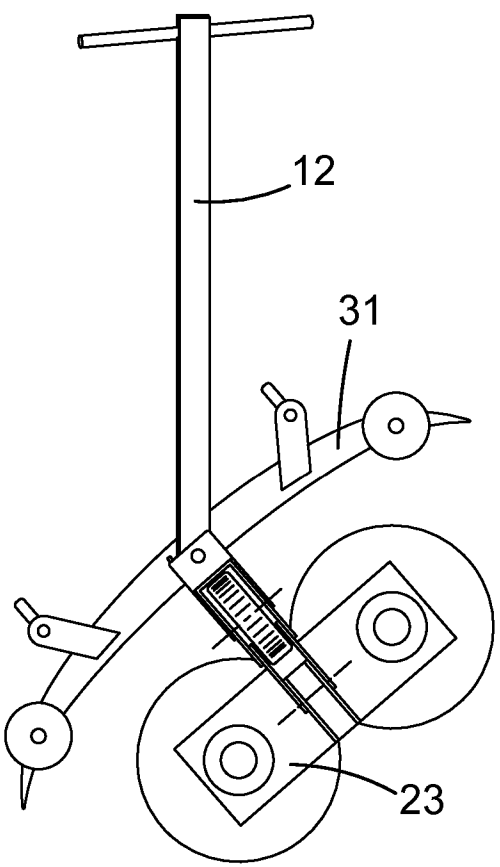
Figure 4A:
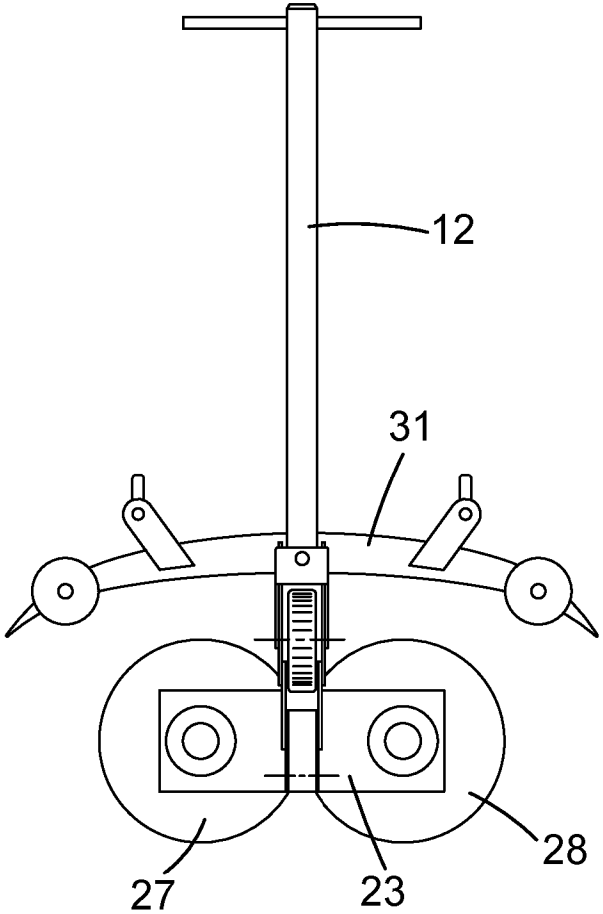

FIGS. 4*a*-4*d* show various configurations of the handle portion 12, the base portion 23 and the wheel yoke 17. FIG. 4*a* shows a configuration in which the handle portion 12 in the left-to-right position and at an angle with the floor surface. The configuration of FIG. 4*a* is similar to that shown in FIG. 1.

FIG. 4*b* shows a configuration in which the handle portion 12 has been rotated such that the handlebar 13 has moved to the left. FIG. 4*b* represents a configuration where a user is turning the machine 10 to the left.

Figure 4D:
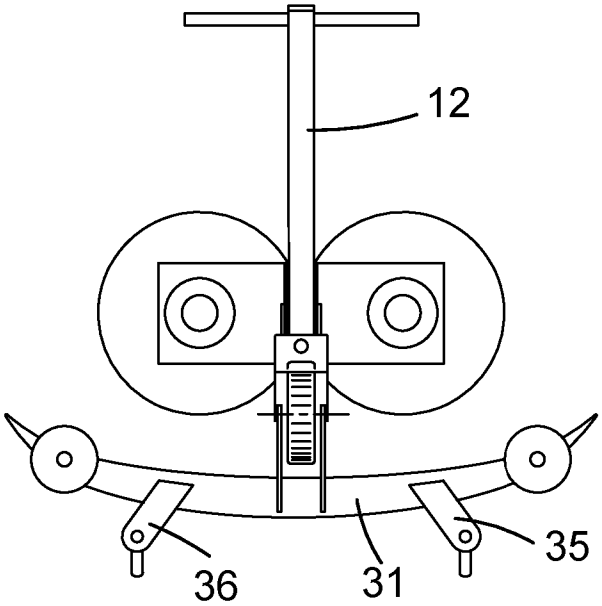
Figure 4C:
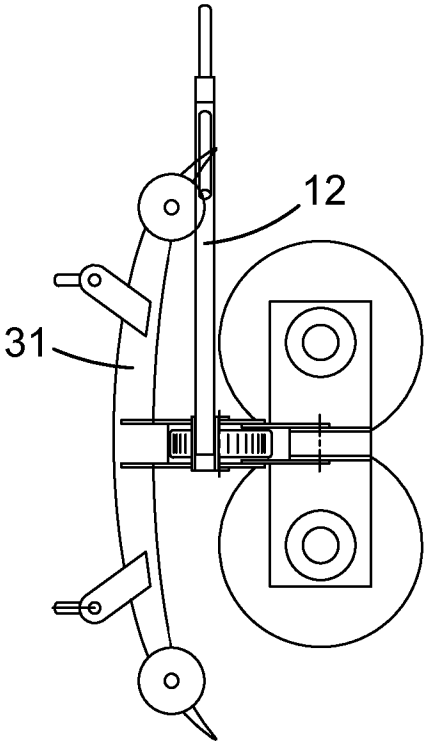

FIG. 4*c* shows a configuration in which the handle portion 12 is upright such that the handlebar 13 is parallel with the floor surface. The handle portion 12 has then been rotated such that the handlebar 13 has moved the left.

FIG. 4*d* shows a configuration in which the handle portion 2 has been rotated such that the handlebar 13 is now positioned forwards of the scrubbers 27, 28.

In the foregoing description and the associated drawings we have not shown features which will typically be present but which are not essential to the core aspects of the invention. These include a cleaning liquid reservoir and dispenser, a suction drive for the squeegee collector, or a dirty water reservoir fed by the squeegee collector. These are well known to the person skilled in the art so are not described in detail herein. For polishing machines or burnishing machines and the like no such ancillary features may be necessary.

In use the machine of the present invention has several unique features and benefits. There is now a further contact point arranged between the scrubber base portion and the floor so the base portion remains stably horizontal to the floor supported by this contact point and the rotating brushes. In this arrangement the wheel 18 rotates as the machine moves forwards but provides a fixed, set distance from the floor to the base portion. This arrangement gives better handling than prior art machines without the guide wheel because the guide wheel acts to prevent yawing of the whole machine base, giving a more positive stable control. It gives longitudinal stability by virtue of its fixed transverse rotational axis, and helps to prevent skidding or slipping of the machine base over the surface of the floor.

Another advantage of the guide wheel is the ability for weight to be carried by the handle over the guide wheel without this weight directly acting on the scrubber brushes to cause the brush filaments to bend excessively or interfere with smooth rotation and scrubbing. Thus heavy machine elements such as clean water or dirty water collection reservoirs can be carried attached to the handle. Similarly suction drive motors or batteries could be carried by, or attached to the handle (preferably in the lower region so as to ensure that weight is transferred to the wheel rather than shared excessively with handle held by the user-operator). In this arrangement the machine provides a stable scrubbing deck which has a performance unaffected by weight changes due to cleaning liquid use or collection.

The invention claimed is:

1. A walk-behind floor treatment machine comprising:

a base portion provided with and supported by at least one rotatable work head for treating the floor, a handle portion for steering or guiding the machine along a working direction of travel and adapted to be pivotable with respect to the base portion, drive means for rotating the at least one rotatable work head with respect to the base portion, floor-engaging wheel means for supporting the handle portion, the wheel means having a substantially transverse axis of rotation so as to permit travel in the working direction, the wheel means being coupled to the base portion by a linkage which permits vertical travel of the base portion and the at least one rotatable work head with respect to the wheel means, but which provides transverse constraint to limit or prevent yawing of the base portion with respect to the wheel means, wherein a lower region of the handle portion is pivotably connected to the wheel means via an articulated joint arrangement which permits up/down pivoting of the handle portion via a first pivot and side-to-side pivoting of the handle portion via a second pivot, the arrangement being such that the handle portion may be manipulated to act on the wheel means so as to yaw steer the wheel means about a vertical yaw axis defined by the floor-engaging contact of the wheel means, the yawing of the wheel means causing the base portion to yaw in response to yaw steering, wherein the at least one rotatable work head includes at least one generally disc-shaped rotatable work head oriented to rotate about a vertical axis of rotation, and wherein the linkage comprises a pitch pivotal connection to the wheel means and a further pitch pivotal connection to the base portion, and the at least one rotatable work head supports the base portion on a floor surface with said pitch pivotal connection of the linkage permitting floating vertical travel of the base portion and the at least one rotatable work head with respect to the wheel means during use of the machine as the machine is moved in the working direction of travel;

wherein the base portion and the at least one rotatable work head are provided at a front region of the machine, the wheel means is disposed aft of the at least one rotatable work head and base portion with the linkage therebetween.

2. The floor treatment machine as claimed in claim 1 wherein the wheel means comprises at least one wheel, roller or ball.

3. The floor treatment machine as claimed in claim 1 wherein the wheel means has a fixed transverse axis of rotation.

4. The floor treatment machine as claimed in claim 1 wherein the up/down pivoting of the first pivot of the articulated joint arrangement is co-axial with the wheel means axis of rotation.

5. The floor treatment machine as claimed in claim 1 wherein the side-to-side pivoting of the second pivot of the articulated joint arrangement is provided at a location vertically spaced apart from the up/down pivoting of the first pivot.

6. The floor treatment machine as claimed in claim 1 wherein the articulated joint arrangement comprises a yoke which accommodates a wheel, roller or ball of the wheel means, which yoke pivots about the wheel rotation axis, thereby to provide the first pivot.

7. The floor treatment machine as claimed in claim 1 wherein the side-to-side pivoting of the second pivot is disposed on an upper bridging portion of the yoke.

8. The floor treatment machine as claimed in claim 1 wherein the machine is configured as a wet scrubbing machine provided with a cleaning fluid reservoir and cleaning fluid delivery outlet.

9. The floor treatment machine as claimed in claim 8 wherein a trailing squeegee liquid collector is provided which is coupled to the machine by a trailing linkage which permits up/down pivoting of the squeegee collector with respect to the wheel means.

10. The floor treatment machine as claimed in claim 9 wherein the trailing linkage is pivotably coupled to the wheel means co-axially with the transverse axis of the wheel means.

11. The floor treatment machine as claimed in claim 1 wherein forward propulsion of the machine is provided by work head rotation.

12. The floor treatment machine as claimed in claim 1 wherein the drive means comprises one or more electric motors carried by the base portion and coupled to the at least one work head.

13. The floor treatment machine as claimed in claim 12 wherein the at least one work head includes two generally disc-shaped work heads disposed side-by-side and oriented to rotate about a respective vertical axis of rotation, wherein there are two electric motors, each disposed one of the two generally disc-shaped work heads, wherein the motors are configured and/or controlled to cause the two generally disc-shaped work heads to counter rotate with respect to one another.

14. The floor treatment machine as claimed in claim 1 wherein the wheel means comprises a single wheel, roller or ball.

15. The floor treatment machine as claimed in claim 1 wherein the pitch pivotal connection to the wheel means is coaxial with the wheel means axis of rotation.

* * * * *